US010937353B2

(12) United States Patent
Kim et al.

(10) Patent No.: US 10,937,353 B2
(45) Date of Patent: Mar. 2, 2021

(54) DISPLAY APPARATUS AND METHOD OF DRIVING DISPLAY PANEL USING THE SAME

(71) Applicant: Samsung Display Co., Ltd., Yongin-si (KR)

(72) Inventors: Kyunho Kim, Hwaseong-si (KR); Sangan Kwon, Cheonan-si (KR); Neung-Beom Lee, Hwaseong-si (KR); Jun Pyo Lee, Anyang-si (KR); Sungjin Kim, Gwangju (KR); Ukjae Jang, Gongju-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/546,092

(22) Filed: Aug. 20, 2019

(65) Prior Publication Data

US 2020/0118476 A1 Apr. 16, 2020

(30) Foreign Application Priority Data

Oct. 10, 2018 (KR) ..... 10-2018-0120760

(51) Int. Cl.
*G09G 3/20* (2006.01)

(52) U.S. Cl.
CPC ..... *G09G 3/2003* (2013.01); *G09G 3/2074* (2013.01); *G09G 2300/0452* (2013.01); *G09G 2320/029* (2013.01); *G09G 2320/0242* (2013.01)

(58) Field of Classification Search
None
See application file for complete search history.

(56) References Cited

U.S. PATENT DOCUMENTS 8,564,627 B2 * 10/2013 Suzuki ..... G09G 3/003 345/690
2012/0293568 A1 * 11/2012 Todorovich ..... G09G 3/3466 345/690

FOREIGN PATENT DOCUMENTS

KR 10-1427115 B1 8/2014
KR 10-2016-0005290 A 1/2016
KR 10-2016-0017191 A 2/2016
KR 10-2017-0048775 A 5/2017

* cited by examiner

*Primary Examiner* — Duane N Taylor, Jr.
(74) *Attorney, Agent, or Firm* — Lewis Roca Rothgerber Christie LLP

(57) ABSTRACT

A display apparatus includes a display panel including a plurality of gate lines, a plurality of data lines, and a plurality of subpixels, the subpixels being connected to the gate lines and the data lines, a driving controller configured to analyze input image data and to determine a driving mode from among one of a first driving mode and a second driving mode, a gate driver configured to output gate signals having timings different from one another to the gate lines in the first driving mode and to output gate signals having the same timing to at least two gate lines in the second driving mode, and a data driver configured to output data voltages to the data lines.

15 Claims, 16 Drawing Sheets

DISPLAY APPARATUS AND METHOD OF DRIVING DISPLAY PANEL USING THE SAME

CROSS-REFERENCE TO RELATED APPLICATION

This application claims priority to and the benefit of Korean Patent Application No. 10-2018-0120760, filed on Oct. 10, 2018 in the Korean Intellectual Property Office KIPO, the content of which is herein incorporated by reference in its entireties.

BACKGROUND

1. Field

Aspects of the present inventive concept relate to a display apparatus and a method of driving a display panel using the display apparatus.

2. Description of the Related Art

A display apparatus includes a display panel and a display panel driver. The display panel includes a plurality of gate lines, a plurality of data lines, and a plurality of subpixels. The display panel driver includes a gate driver, a data driver and a driving controller. The gate driver outputs gate signals to the gate lines. The data driver outputs data voltages to the data lines. The driving controller controls the gate driver and the data driver.

As a resolution of the display panel increases, a charging time of the data voltage may decrease. Due to the decrease of the charging time of the data voltage, a charging rate of the data voltage may not be enough to represent a desirable color.

SUMMARY

Aspects of embodiments of the present inventive concept are directed to a display apparatus that compensates charging time of a data voltage to enhance a display quality.

Aspects of embodiments of the present inventive concept are directed to a display apparatus that analyzes input image data and compensates a charging time of a data voltage by concurrently driving a plurality of gate lines when the image data, which may benefit from compensation of the charging time of the data voltage, are inputted.

Aspects of embodiments of the present inventive concept are also directed to a method of driving a display panel using the above-mentioned display apparatus.

According to some exemplary embodiments of the present inventive concept, there is provided a display apparatus including: a display panel including a plurality of gate lines, a plurality of data lines, and a plurality of subpixels, the subpixels being connected to the gate lines and the data lines; a driving controller configured to analyze input image data and to determine a driving mode from among one of a first driving mode and a second driving mode; a gate driver configured to output gate signals having timings different from one another to the gate lines in the first driving mode and to output gate signals having the same timing to at least two gate lines in the second driving mode; and a data driver configured to output data voltages to the data lines.

In some embodiments, the driving controller is configured to determine the driving mode as the second driving mode when the input image data includes a single color pattern.

In some embodiments, the driving controller is configured to determine the driving mode as the second driving mode when adjacent same-color subpixels in a two by two matrix have the same grayscale level in the input image data.

In some embodiments, subpixels having the same color are arranged in a row direction in the display panel, and wherein a subpixel having a first color, a subpixel having a second color and a subpixel having a third color are alternately arranged in a column direction in the display panel.

In some embodiments, subpixels having the first color and connected to a first gate line are arranged in a first row, subpixels having the second color and connected to a second gate line are arranged in a second row, subpixels having the third color and connected to a third gate line are arranged in a third row, subpixels having the first color and connected to a fourth gate line are arranged in a fourth row, subpixels having the second color and connected to a fifth gate line are arranged in a fifth row, and subpixels having the third color and connected to a sixth gate line are arranged in a sixth row in the display panel, and, in the second driving mode, a first gate signal applied to the first gate line and a fourth gate signal applied to the fourth gate line have active levels in a first period, a second gate signal applied to the second gate line and a fifth gate signal applied to the fifth gate line have active levels in a second period different from the first period, a third gate signal applied to the third gate line and a sixth gate signal applied to the sixth gate line have active levels in a third period different from the first period and the second period.

In some embodiments, subpixels having the first color and connected to a first gate line are arranged in a first row, subpixels having the second color and connected to a second gate line are arranged in a second row, subpixels having the third color and connected to a third gate line are arranged in a third row, subpixels having the first color and connected to a fourth gate line are arranged in a fourth row, subpixels having the second color and connected to a fifth gate line are arranged in a fifth row, subpixels having the third color and connected to a sixth gate line are arranged in a sixth row, subpixels having the first color and connected to a seventh gate line are arranged in a seventh row, subpixels having the second color and connected to an eighth gate line are arranged in an eighth row, subpixels having the third color and connected to a ninth gate line are arranged in a ninth row, subpixels having the first color and connected to a tenth gate line are arranged in a tenth row, subpixels having the second color and connected to an eleventh gate line are arranged in an eleventh row, and subpixels having the third color and connected to a twelfth gate line are arranged in a twelfth row in the display panel, and wherein, in the second driving mode, a first gate signal applied to the first gate line, a fourth gate signal applied to the fourth gate line, a seventh gate signal applied to the seventh gate line, and a tenth gate signal applied to the tenth gate line have active levels in a first period, wherein a second gate signal applied to the second gate line, a fifth gate signal applied to the fifth gate line, an eighth gate signal applied to the eighth gate line, and an eleventh gate signal applied to the eleventh gate line have active levels in a second period different from the first period, and wherein a third gate signal applied to the third gate line, a sixth gate signal applied to the sixth gate line, a ninth gate signal applied to the ninth gate line, and a twelfth gate signal applied to the twelfth gate line have active levels in a third period different from the first period and the second period.

In some embodiments, the data lines are connected to the subpixels having the first color, the subpixels having the second color, and the subpixels having the third color arranged in a single pixel column.

In some embodiments, the driving controller is configured to determine the driving mode as the second driving mode when the input image data includes a single color pattern or when adjacent same-color subpixels in two by two matrix have the same grayscale level in the input image data.

In some embodiments, the data lines are alternately connected to the subpixels having the first color, the subpixels having the second color, and the subpixels having the third color arranged in two adjacent pixel columns.

In some embodiments, the driving controller is configured to determine the driving mode as the second driving mode when the input image data includes a single color pattern.

In some embodiments, a subpixel having a first color, a subpixel having a second color and a subpixel having a third color are alternately arranged in a row direction in the display panel, and subpixels having the same color are arranged in a column direction in the display panel.

In some embodiments, in the second driving mode, a first gate signal applied to a first gate line and a second gate signal applied to a second gate line have active levels in a first period, a third gate signal applied to a third gate line and a fourth gate signal applied to a fourth gate line have active levels in a second period different from the first period, and a fifth gate signal applied to a fifth gate line and a sixth gate signal applied to a sixth gate line have active levels in a third period different from the first period and the second period.

In some embodiments, in the second driving mode, first to fourth gate signals respectively applied to a first to fourth gate lines have active levels in a first period, fifth to eighth gate signals respectively applied to fifth to eighth gate lines have active levels in a second period different from the first period, and ninth to twelfth gate signals respectively applied to ninth to twelfth gate lines have active levels in a third period different from the first period and the second period.

In some embodiments, the driving controller is configured to analyze the input image data frame by frame and to determine the driving mode from among one of the first driving mode and the second driving mode for a frame.

In some embodiments, the driving controller is configured to analyze the input image data line by line and to determine the driving mode from among one of the first driving mode and the second driving mode for a line, and a first portion of a frame image is displayed on the display panel in the first driving mode and a second portion of the frame image is displayed on the display panel in the second driving mode.

According to some exemplary embodiments of the present inventive concept, there is provided a method of driving a display panel, the method including: analyzing input image data; determining a driving mode from among one of a first driving mode and a second driving mode based on the input image data; outputting gate signals having timings different from one another to gate lines of the display panel in the first driving mode and outputting gate signals having the same timing to at least two gate lines in the second driving mode; and outputting data voltages to data lines of the display panel.

In some embodiments, the driving mode is determined as the second driving mode when the input image data includes a single color pattern.

In some embodiments, the driving mode is determined as the second driving mode when adjacent same-color subpixels in two by two matrix have the same grayscale level in the input image data.

In some embodiments, the input image data are analyzed frame by frame and the driving mode is determined from among one of the first driving mode and the second driving mode for a frame.

In some embodiments, the input image data are analyzed line by line and the driving mode is determined from among one of the first driving mode and the second driving mode for a line, and a first portion of a frame image is displayed on the display panel in the first driving mode and a second portion of the frame image is displayed on the display panel in the second driving mode.

According to the display apparatus and the method of driving the display panel using the display apparatus, the input image data may be analyzed and the charging time of the data voltage may be compensated by concurrently driving the plurality of the gate lines when the image data, which may benefit from compensation of the charging time of the data voltage, are inputted. The charging time of the data voltage is compensated so that the charging rate of the data voltage may be enhanced (e.g., increased). When the charging rate of the data voltage is enhanced, the display quality of the display panel may be enhanced.

BRIEF DESCRIPTION OF THE DRAWINGS

The above and other features and advantages of the present inventive concept will become more apparent by describing in detailed exemplary embodiments thereof with reference to the accompanying drawings, in which.

DETAILED DESCRIPTION

Hereinafter, the present inventive concept will be explained in detail with reference to the accompanying drawings.

Figure 1:
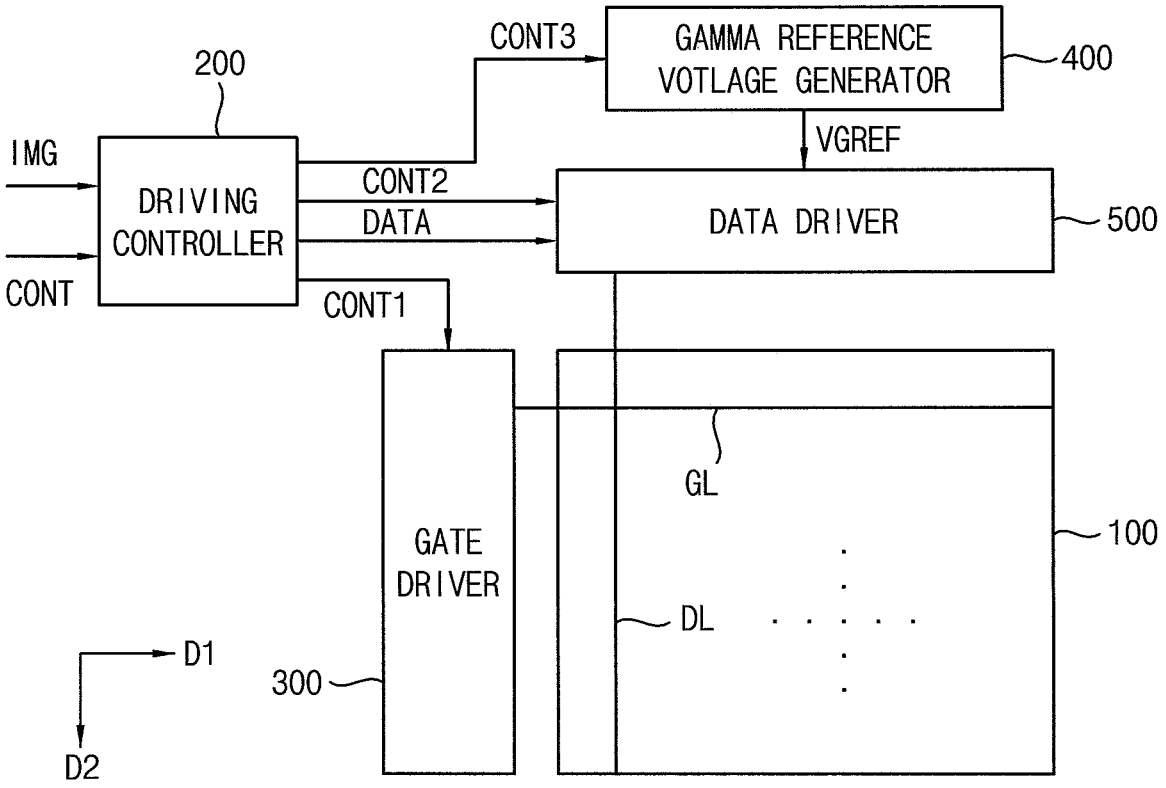
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a display panel driver. The display panel driver includes a driving controller 200, a gate driver 300, a gamma reference voltage generator 400, and a data driver 500.

In some examples, the driving controller 200 and the data driver 500 may be integrally formed. In some examples, the driving controller 200, the gamma reference voltage generator 400, and the data driver 500 may be integrally formed. In some examples, the driving controller 200, the gate driver 300, the gamma reference voltage generator 400, and the data driver 500 may be integrally formed.

The display panel 100 includes a display region and a peripheral region adjacent to the display region.

For example, the display panel 100 may be a liquid crystal display panel including liquid crystal molecules. In some examples, the display panel 100 may be an organic light emitting diode display panel including organic light emitting diodes.

The display panel 100 includes a plurality of gate lines GL, a plurality of data lines DL and a plurality of subpixels electrically connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus. In some examples, the input image data IMG may include red image data, green image data, and blue image data. The input image data IMG may further include white image data. In some examples, the input image data IMG may include magenta image data, yellow image data, and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type (e.g., smooth, continuous, and non-digital voltage signal) using the gamma reference voltages VGREF. The data driver 500 outputs the data voltages to the data lines DL.

Figure 2:
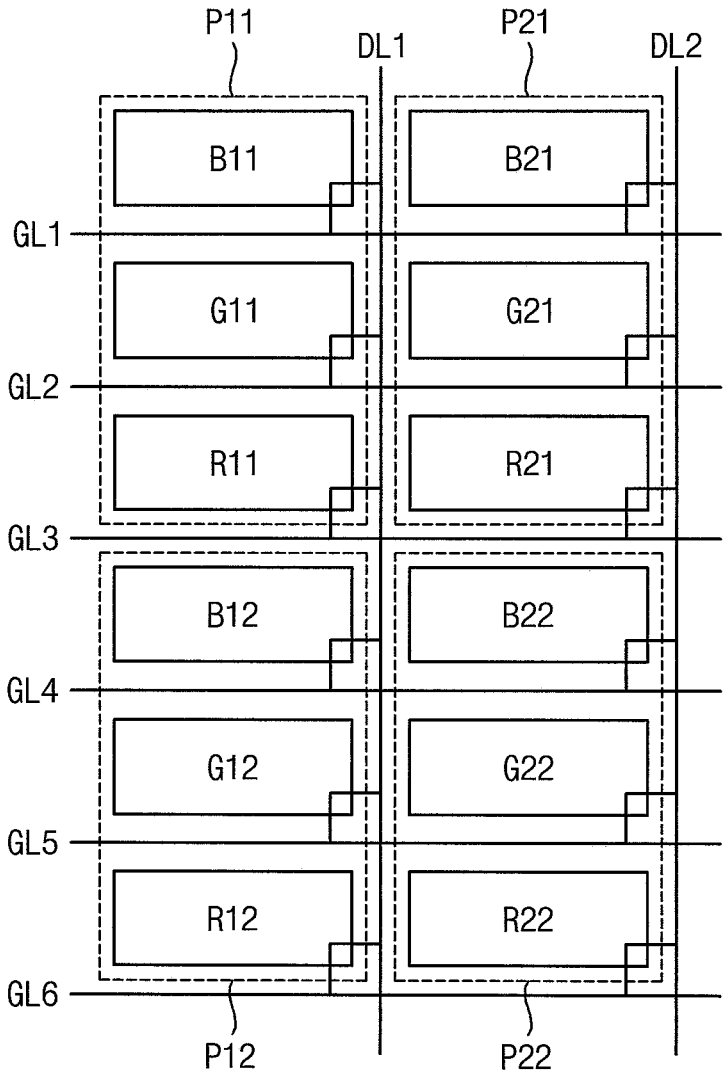
FIG. 2 is a conceptual diagram illustrating a pixel structure of a display panel of FIG. 1.

FIG. 2 is a conceptual diagram illustrating a pixel structure of the display panel 100 of FIG. 1.

Referring to FIGS. 1 and 2, subpixels having the same color are disposed in a row direction D1 and a first color subpixel, a second color subpixel, and a third color subpixel are alternately disposed in a column direction D2 in the display panel 100.

For example, the first color subpixel may be a blue subpixel. For example, the second color subpixel may be a green subpixel. For example, the third color subpixel may be a red subpixel. The blue subpixels may be disposed in an uppermost row of the display panel 100. A charging rate of the subpixel in the uppermost row of the display panel 100 may be less than a charging rate of the subpixel in another row of the display panel 100 according to a driving method so that the blue subpixel which has a less luminance influence than other color subpixels may be disposed in the uppermost row of the display panel 100.

In the display panel 100, the first color subpixels B11 and B21 connected to a first gate line GL1 are disposed in a first row, the second color subpixels G11 and G21 connected to a second gate line GL2 are disposed in a second row, the third color subpixels R11 and R21 connected to a third gate line GL3 are disposed in a third row, the first color subpixels B12 and B22 connected to a fourth gate line GL4 are disposed in a fourth row, the second color subpixels G12 and G22 connected to a fifth gate line GL5 are disposed in a fifth row and the third color subpixels R12 and R22 connected to a sixth gate line GL6 are disposed in a sixth row.

The first color subpixel, the second color subpixel, and the third color subpixel disposed adjacent to each other in the column direction D2 may form a pixel.

For example, a first blue subpixel B11, a first green subpixel G11 and a first red subpixel R11, which are disposed in a first column may form a first pixel P11. For example, a second blue subpixel B12, a second green subpixel G12, and a second red subpixel R12, which are disposed in the first column may form a second pixel P12. For example, a third blue subpixel B21, a third green subpixel G21, and a third red subpixel R21, which are disposed in a second column may form a third pixel P21. For example, a fourth blue subpixel B22, a fourth green subpixel G22, and a fourth red subpixel R22, which are disposed in the second column may form a fourth pixel P22.

In the present exemplary embodiment, the data line may be connected to the first color subpixel, the second color subpixel, and the third color subpixel disposed in the single pixel column. For example, a first data line DL1 may be connected to the first color subpixels B11 and B12, the second color subpixels G11 and G12 and the third color subpixels R11 and R12 disposed in a first pixel column. For example, a second data line DL2 may be connected to the first color subpixels B21 and B22, the second color subpixels G21 and G22 and the third color subpixels R21 and R22 disposed in a second pixel column.

Figure 3A:
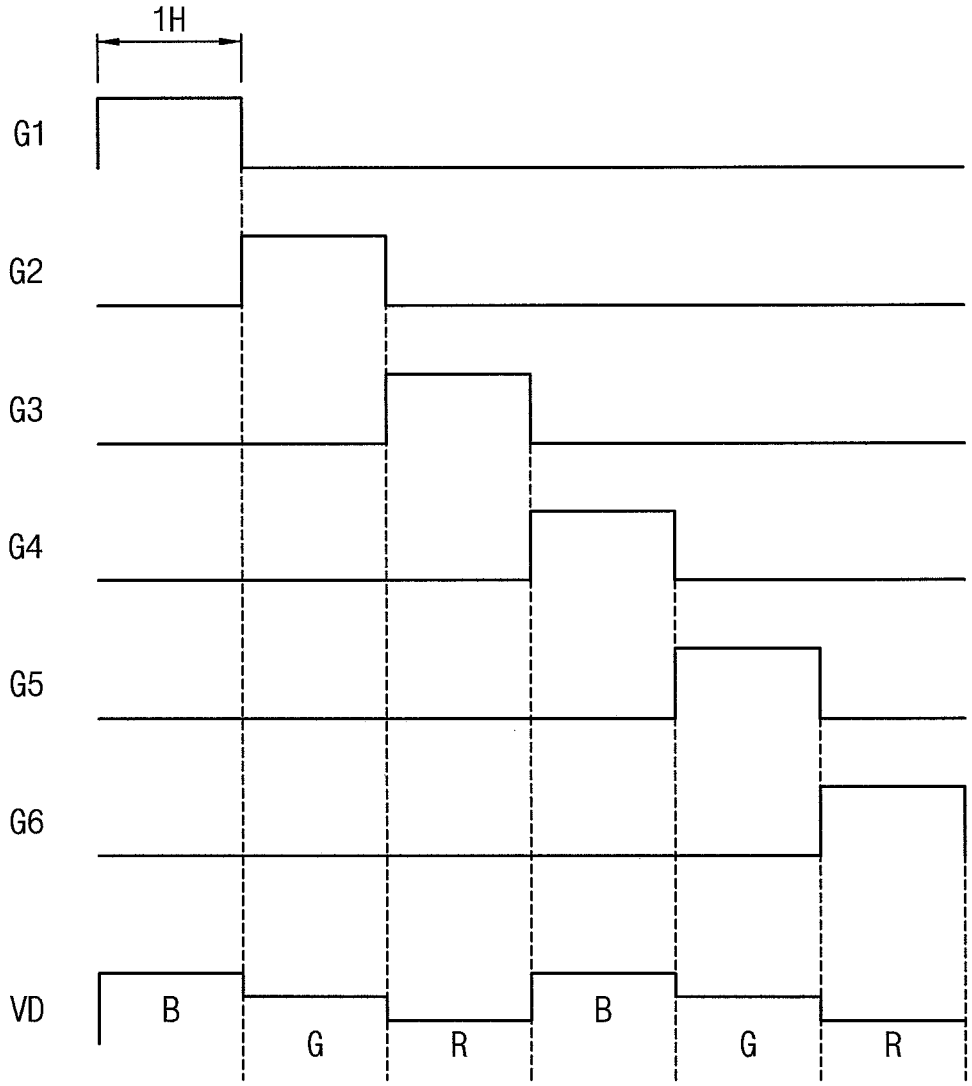
FIG. 3A is a conceptual diagram illustrating a gate signal and a data voltage applied to subpixels of FIG. 2 in a first driving mode.
Figure 3B:
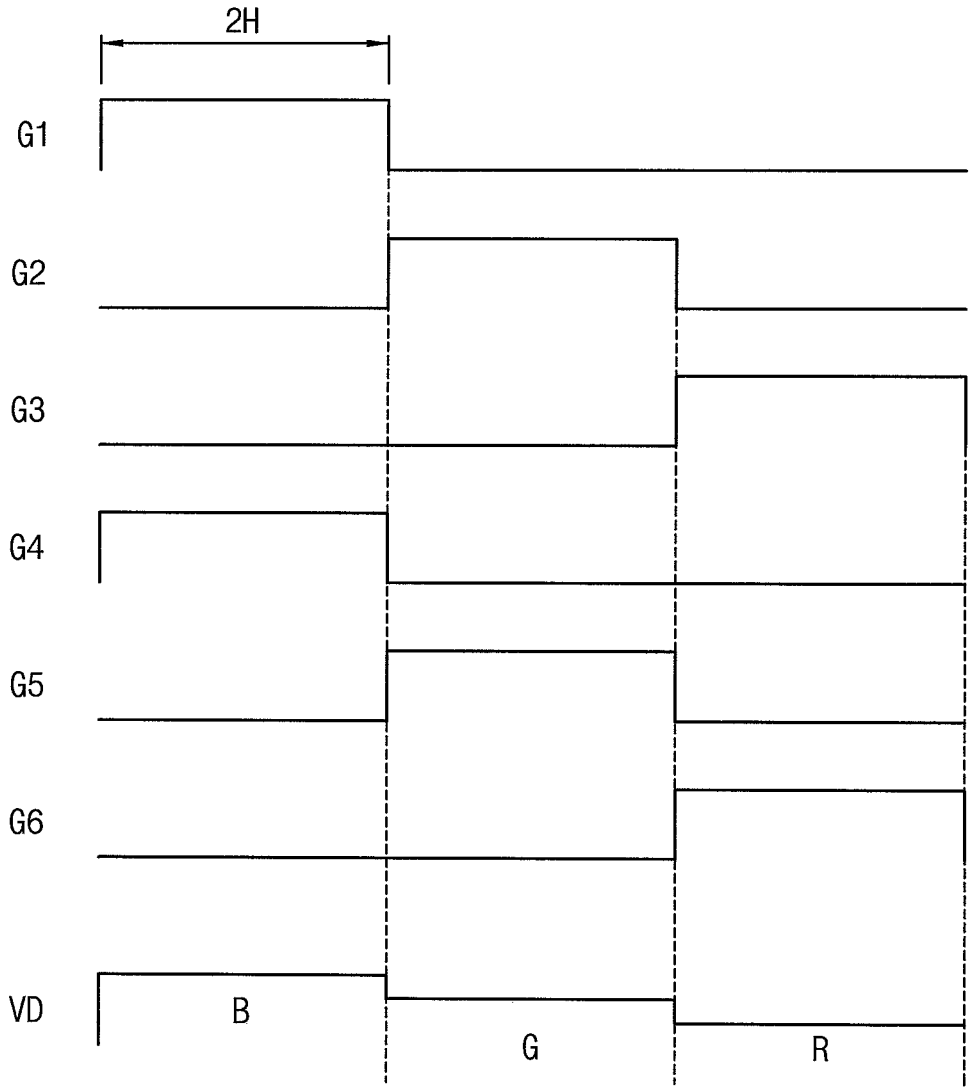
FIG. 3B is a conceptual diagram illustrating a gate signal and a data voltage applied to the subpixels of FIG. 2 in a second driving mode.
Figure 4:
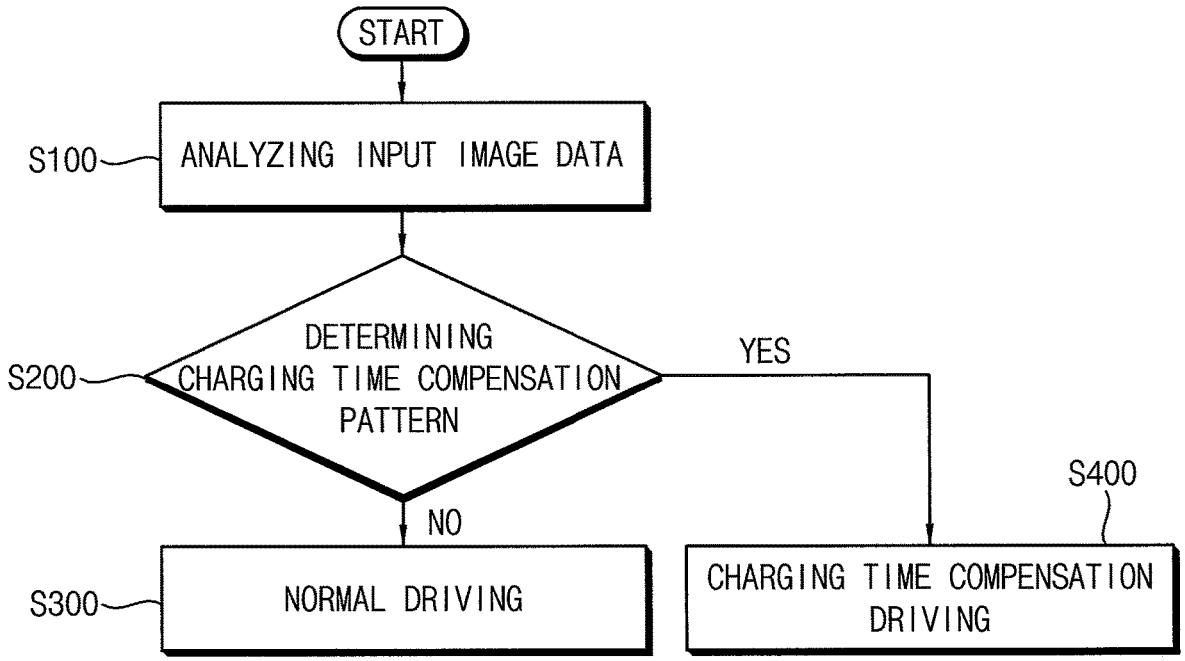
FIG. 4 is a flow diagram illustrating a method of driving the display panel of FIG. 1.

FIG. 3A is a conceptual diagram illustrating a gate signal and a data voltage applied to the subpixels of FIG. 2 in a first driving mode. FIG. 3B is a conceptual diagram illustrating a gate signal and a data voltage applied to the subpixels of FIG. 2 in a second driving mode. FIG. 4 is a flow diagram illustrating a method of driving the display panel 100 of FIG. 1.

Referring to FIGS. 1 to 4, the driving controller 200 analyzes the input image data IMG (S100). The driving controller 200 may determine a driving mode from among one of a first driving mode and a second driving mode based on the input image data IMG (S200). When the input image data IMG includes a charging time compensation pattern, which may benefit from a compensation of the charging time of the data voltage, the driving controller 200 may determine the driving mode as the second driving mode (e.g., a charging time compensation driving mode). When the input image data IMG does not include the charging time compensation pattern, which requires the compensation of the charging time of the data voltage, the driving controller 200 may determine the driving mode as the first driving mode (e.g., a normal driving mode).

The gate driver 300 may output the gate signals having timings different from one another to the gate lines in the first driving mode (S300).

As shown in FIG. 3A, for example, the gate driver 300 may output the gate signals having timings different from one another to the all of the gate lines of the display panel 100.

The subpixels connected to the first gate line GL1 are blue subpixels so that the data voltages VD may be voltages representing grayscale values for the blue subpixels when a first gate signal G1 applied to the first gate line GL1 has an active level. The subpixels connected to the second gate line GL2 are green subpixels so that the data voltages VD may be voltages representing grayscale values for the green subpixels when a second gate signal G2 applied to the second gate line GL2 has an active level. The subpixels connected to the third gate line GL3 are red subpixels so that the data voltages VD may be voltages representing grayscale values for the red subpixels when a third gate signal G3 applied to the third gate line GL3 has an active level.

The gate driver 300 may output the gate signals having the same timing to at least two gate lines in the second driving mode (S400).

In the present exemplary embodiment, the gate driver 300 may output the gate signals having the same timing to two adjacent gate lines connected to the same-color subpixels in the second driving mode.

As shown in FIG. 3B, in the second driving mode, the first gate signal G1 applied to the first gate line GL1 and a fourth gate signal G4 applied to the fourth gate line GL4 have active levels in a first period (e.g., a first timing), the second gate signal G2 applied to the second gate line GL2 and a fifth gate signal G5 applied to the fifth gate line GL5 have active levels in a second period (e.g., a second timing) different from the first timing, the third gate signal G3 applied to the third gate line GL3 and a sixth gate signal G6 applied to the sixth gate line GL6 have active levels in a third period (e.g., a third timing) different from the first period and the second timing.

In the second driving mode, two gate lines have the same timing so that a turn-on period 2 H of the gate signal when the gate signal has the active level may be twice of a turn-on period 1 H of the gate signal in the first driving mode. Thus, in the second driving mode, the charging time of the data voltage VD may be increased.

The driving controller 200 may adjust the output timing of the data voltage of the data driver 500 according to the driving timing of the gate driver 300. For example, when the turn-on period of the gate driver 300 is increased twice in the second driving mode, the driving controller 200 may control that the data driver 500 outputs two duplicated data voltage VD. In some examples, when the turn-on period of the gate driver 300 is increased twice in the second driving mode, the driving controller 200 may control that the data driver 500 outputs the data voltage VD in a speed half of a speed of the first driving mode.

In the present exemplary embodiment, the charging time compensation pattern may be a single color pattern. As shown in FIG. 2, the display panel 100 includes the first color subpixel, the second color subpixel, and the third color subpixel alternately disposed in the column direction. When the display panel 100 represents a blue single color pattern, the data voltage VD applied to the data line has a high level value corresponding to the blue subpixel and low level values corresponding to the green and red subpixels. When the data voltage VD swings between the high level value and the low level value in a high resolution display panel, which has an insufficient charging time, the blue subpixel may not be sufficiently charged. Similarly, when the display panel 100 represents a green single color pattern, a red single color pattern, a magenta single color pattern, a cyan single color pattern, and a yellow single color pattern, some of the subpixels of the display panel 100 may not be sufficiently charged.

In the present exemplary embodiment, the charging time compensation pattern may be a low resolution image pattern. When the display panel 100 has the maximum resolution of UHD resolution (e.g. 3840*2160) and the resolution of the input image data IMG is FHD resolution (e.g. 1920*1080), gate signals may be concurrently outputted to the two gate lines without deterioration of the quality of the display image. Thus, when the input image data IMG includes the low resolution image pattern, the charging time compensation driving may be performed so that the charging rate of the subpixels of the display panel 100 may be enhanced.

For example, in the low resolution image pattern, adjacent same-color subpixels in a two by two matrix may have the same grayscale level. For example, when the display panel 100 has the maximum resolution of UHD resolution (e.g. 3840*2160), the resolution of the low resolution image pattern may be FHD resolution (e.g. 1920*1080) or HD resolution (1366*768). For example, when the display panel 100 has the maximum resolution of 8K resolution (e.g. 7680*3420), the resolution of the low resolution image pattern may be UHD resolution (e.g. 3840*2160), FHD resolution (e.g. 1920*1080) or HD resolution (1366*768).

In the present exemplary embodiment, the driving controller 200 analyzes the input image data IMG and determines the driving mode from among one of the first driving mode and the second driving mode based on the input image data IMG.

When a present frame data of the input image data IMG includes the charging time compensation pattern, the gate driver 300 and the data driver 500 perform the charging time compensation driving (S400).

When the present frame data of the input image data IMG does not include the charging time compensation pattern, the gate driver 300 and the data driver 500 perform the normal driving (S300).

For example, according to the frame image of the input image data IMG, a first frame may be driven in the second driving mode, and a second frame adjacent to the first frame may be driven in the first driving mode.

According to the present exemplary embodiment, the input image data IMG may be analyzed and the charging time of the data voltage VD may be compensated by concurrently driving the plurality of the gate lines when the image data, which may benefit from compensation of the charging time of the data voltage VD, are inputted. The charging time of the data voltage VD is compensated so that the charging rate of the data voltage VD may be enhanced (e.g., increased). When the charging rate of the data voltage VD is enhanced, the display quality of the display panel 100 may be enhanced.

Figure 5A:
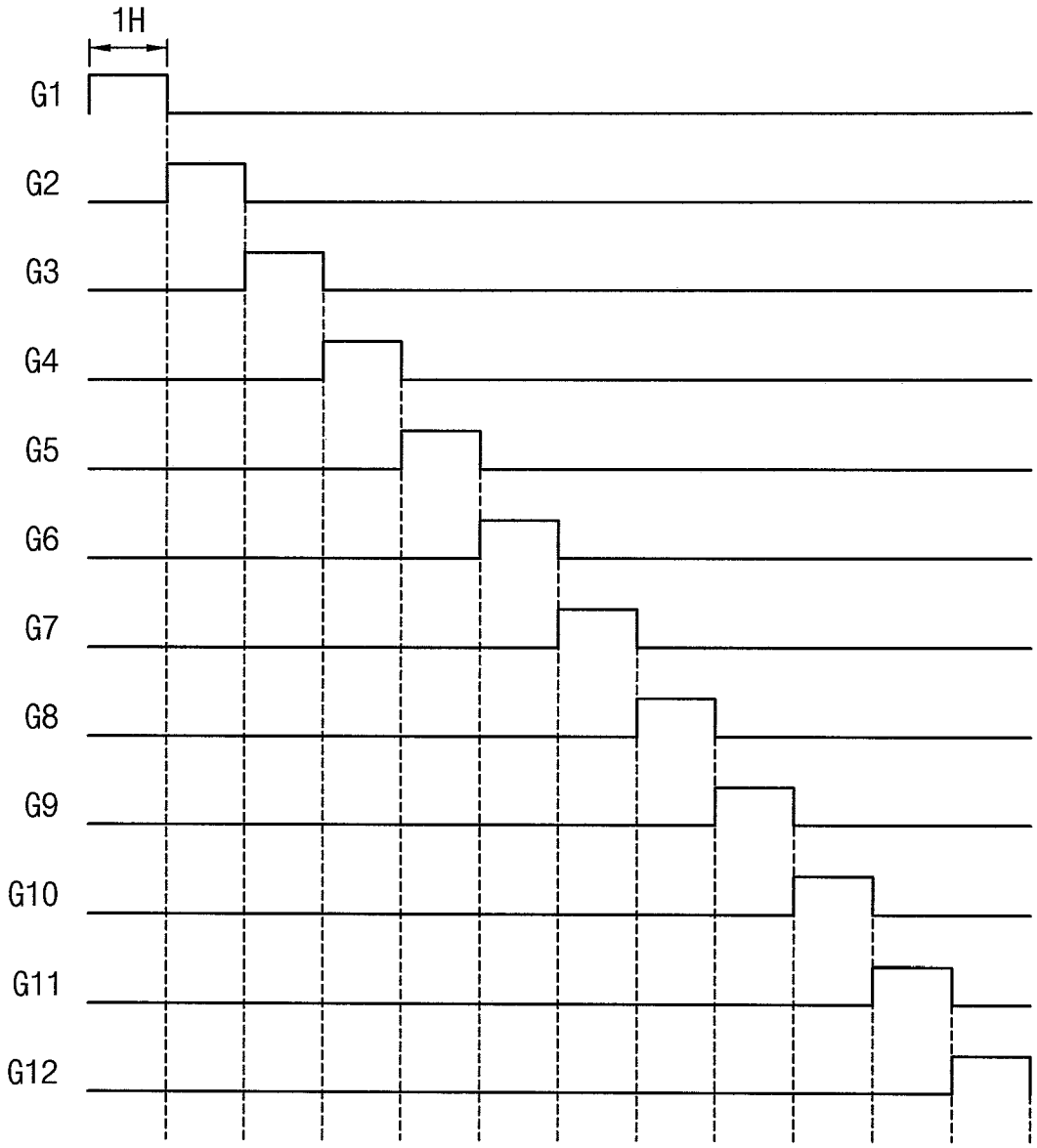
FIG. 5A is a conceptual diagram illustrating a gate signal and a data voltage applied to subpixels of a display panel in a first driving mode, according to an exemplary embodiment of the present inventive concept.
Figure 5B:
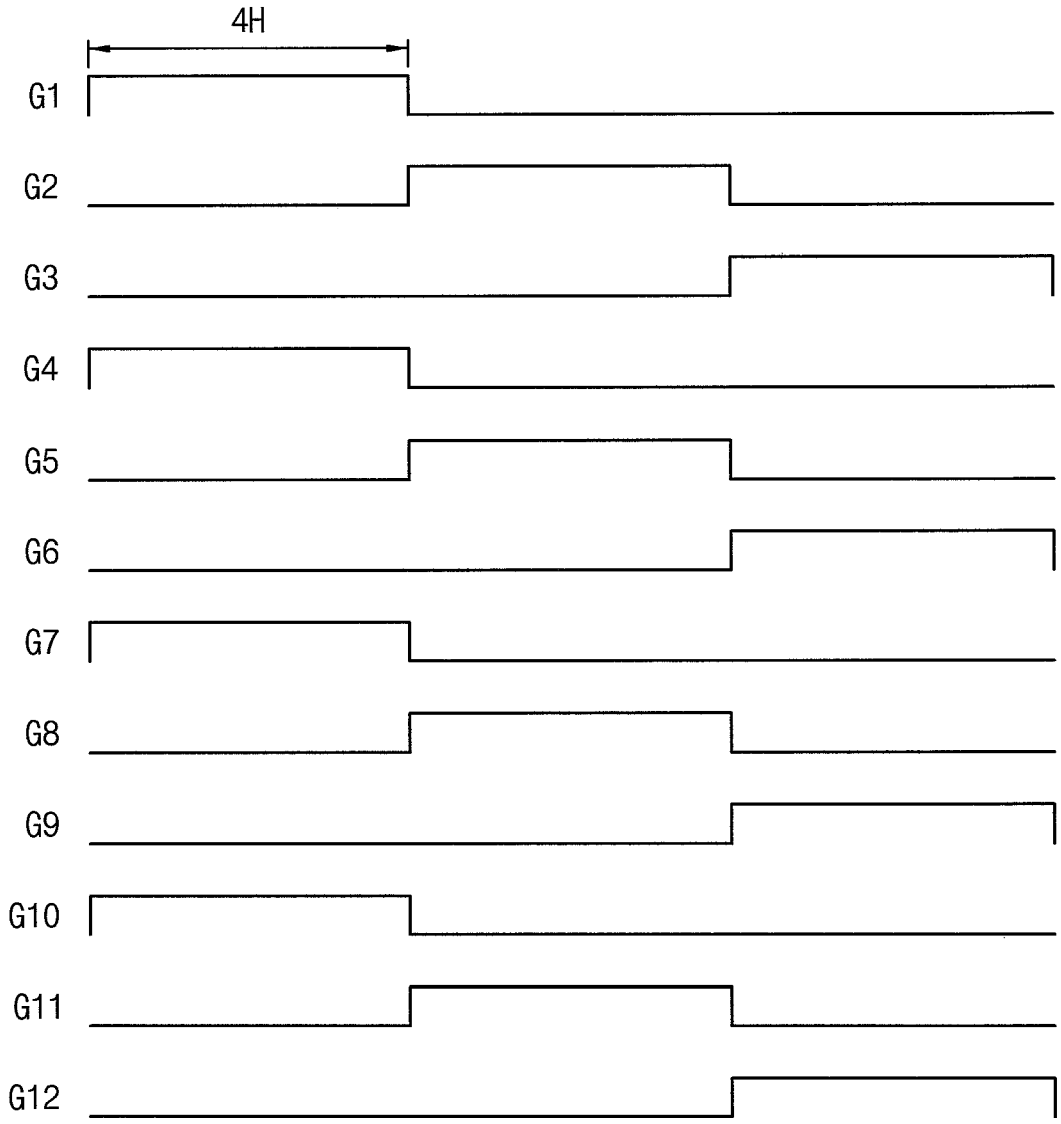
FIG. 5B is a conceptual diagram illustrating a gate signal and a data voltage applied to the subpixels of FIG. 5A in a second driving mode.

FIG. 5A is a conceptual diagram illustrating a gate signal and a data voltage applied to subpixels of a display panel in a first driving mode, according to an exemplary embodiment of the present inventive concept. FIG. 5B is a conceptual diagram illustrating a gate signal and a data voltage applied to the subpixels of FIG. 5A in a second driving mode.

The display apparatus and the method of driving the display panel according to the present exemplary embodiment is substantially the same as the display apparatus and the method of driving the display panel of the previous exemplary embodiment explained with reference to FIGS. 1 to 4, except that the gate signals are concurrently outputted to the four adjacent gate lines connected to the same-color subpixels in the second driving mode. Thus, the same reference numerals will be used to refer to the same or like parts as those described in the previous exemplary embodiment of FIGS. 1 to 4 and any repetitive explanation concerning the above elements may be omitted.

Referring to FIGS. 1, 2, 4, 5A and 5B, the display apparatus includes a display panel 100 and a display panel driver. The display panel driver includes a driving controller 200, a gate driver 300, a gamma reference voltage generator 400, and a data driver 500.

The driving controller 200 analyzes the input image data IMG. The driving controller 200 may determine a driving mode from among one of a first driving mode and a second driving mode based on the input image data IMG.

The gate driver 300 may output the gate signals having timings different from one another to the gate lines in the first driving mode.

As shown in FIG. 5A, for example, the gate driver 300 may output the gate signals having timings different from one another to the all of the gate lines of the display panel 100.

The gate driver 300 may output the gate signals having the same timing to at least two gate lines in the second driving mode.

In the present exemplary embodiment, the gate driver 300 may output the gate signals having the same timing to four adjacent gate lines connected to the same-color subpixels in the second driving mode.

As shown in FIG. 5B, in the second driving mode, the first gate signal G1 applied to the first gate line GL1, a fourth gate signal G4 applied to the fourth gate line GL4, a seventh gate signal G7 applied to a seventh gate line GL7, and a tenth gate signal G10 applied to a tenth gate line GL10 have active levels in a first period; the second gate signal G2 applied to the second gate line GL2, a fifth gate signal G5 applied to the fifth gate line GL5, an eighth gate signal G8 applied to an eighth gate line GL8, and an eleventh gate signal G11 applied to an eleventh gate line GL11 have active levels in a period timing different from the first timing; and the third gate signal G3 applied to the third gate line GL3, a sixth gate signal G6 applied to the sixth gate line GL6, a ninth gate signal G9 applied to a ninth gate line GL9, and a twelfth gate signal G12 applied to a twelfth gate line GL12 have active levels in a third period (e.g., a third timing) different from the first period and the second period.

In the second driving mode, four gate lines have the same timing so that a turn-on period 4 H of the gate signal when the gate signal has the active level may be four times the turn-on period 1 H of the gate signal in the first driving mode. Thus, in the second driving mode, the charging time of the data voltage VD may be increased.

According to the present exemplary embodiment, the input image data IMG may be analyzed and the charging time of the data voltage VD may be compensated by concurrently driving the plurality of the gate lines when the image data, which may benefit from compensation of the charging time of the data voltage VD, are inputted. The charging time of the data voltage VD is compensated so that the charging rate of the data voltage VD may be enhanced. When the charging rate of the data voltage VD is enhanced, the display quality of the display panel 100 may be enhanced.

Figure 6:
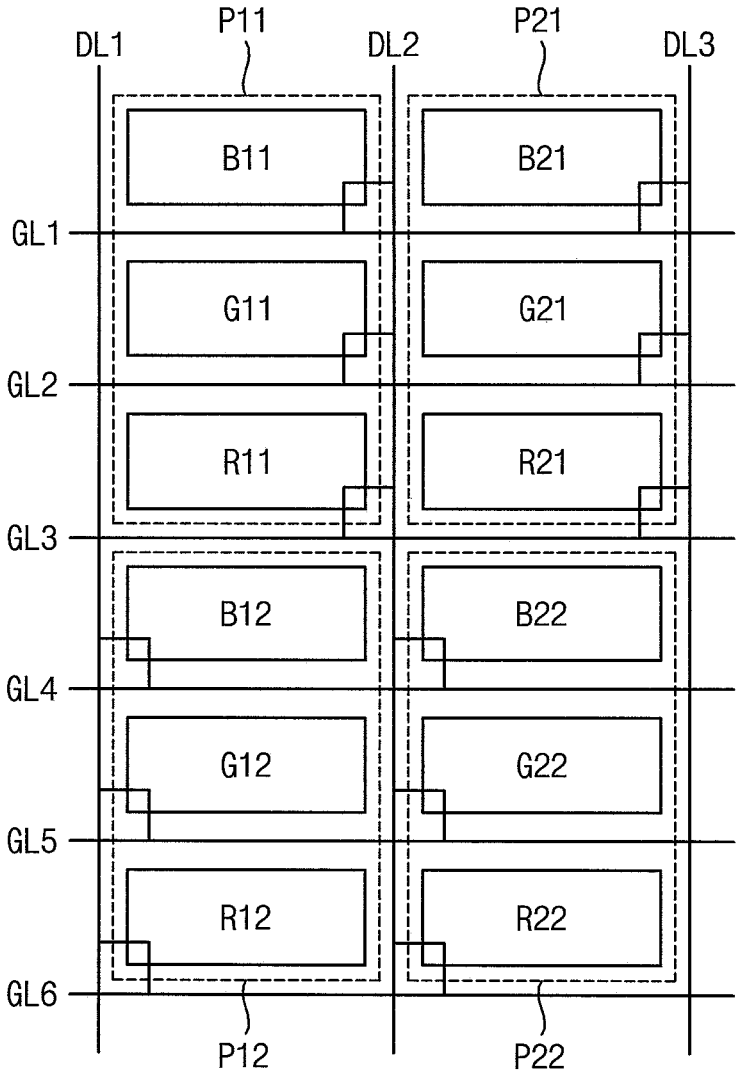
FIG. 6 is a conceptual diagram illustrating a pixel structure of a display panel according to an exemplary embodiment of the present inventive concept.

FIG. 6 is a conceptual diagram illustrating a pixel structure of a display panel according to an exemplary embodiment of the present inventive concept.

The display apparatus and the method of driving the display panel according to the present exemplary embodiment is substantially the same as the display apparatus and the method of driving the display panel of the previous exemplary embodiment explained with reference to FIGS. 1 to 4, except for the pixel structure of the display panel. Thus, the same reference numerals will be used to refer to the same or like parts as those described in the previous exemplary embodiment of FIGS. 1 to 4 and any repetitive explanation concerning the above elements may be omitted.

Referring to FIGS. 1, 3A, 3B, 4 and 6, the display apparatus includes a display panel 100 and a display panel driver. The display panel driver includes a driving controller 200, a gate driver 300, a gamma reference voltage generator 400, and a data driver 500.

Subpixels having the same color are disposed in a row direction D1, and a first color subpixel, a second color subpixel, and a third color subpixel are alternately disposed in a column direction D2 in the display panel 100.

In the display panel 100, the first color subpixels B11 and B21 connected to a first gate line GL1 are disposed in a first row, the second color subpixels G11 and G21 connected to a second gate line GL2 are disposed in a second row, the third color subpixels R11 and R21 connected to a third gate line GL3 are disposed in a third row, the first color subpixels B12 and B22 connected to a fourth gate line GL4 are disposed in a fourth row, the second color subpixels G12 and G22 connected to a fifth gate line GL5 are disposed in a fifth row, and the third color subpixels R12 and R22 connected to a sixth gate line GL6 are disposed in a sixth row.

In the present exemplary embodiment, the data line may be alternately connected to the first color subpixel, the second color subpixel and the third color subpixel disposed in two adjacent pixel columns. The data line may be alternately connected to the subpixels in two adjacent pixel columns by three subpixels.

For example, a first data line DL1 may be connected to the first color subpixel B12, the second color subpixel G12, and the third color subpixel R12 disposed in a first pixel column. For example, a second data line DL2 may be connected to the first color subpixel B11, the second color subpixel G11, and the third color subpixel R11 disposed in the first pixel column and the first color subpixel B12, the second color subpixel G12, and the third color subpixel R12 disposed in the second pixel column. For example, a third data line DL3 may be connected to the first color subpixel B21, the second color subpixel G21, and the third color subpixel R21 disposed in the second pixel column.

The driving controller 200 analyzes the input image data IMG. The driving controller 200 may determine a driving mode from among one of a first driving mode and a second driving mode based on the input image data IMG.

The gate driver 300 may output the gate signals having timings different from one another to the gate lines in the first driving mode.

The gate driver 300 may output the gate signals having the same timing to at least two gate lines in the second driving mode.

In the present exemplary embodiment, the charging time compensation pattern may be a single color pattern. As shown in FIG. 2, the display panel 100 includes the first color subpixel, the second color subpixel, and the third color subpixel alternately disposed in the column direction. When the display panel 100 represents a blue single color pattern, the data voltage VD applied to the data line has a high level value corresponding to the blue subpixel and low level values corresponding to the green and red subpixels. When the data voltage VD swings between the high level value and the low level value in a high resolution display panel, which has an insufficient charging time, the blue subpixel may not be sufficiently charged. Similarly, when the display panel 100 represents a green single color pattern, a red single color pattern, a magenta single color pattern, a cyan single color pattern, and a yellow single color pattern, some of the subpixels of the display panel 100 may not be sufficiently charged.

In the present exemplary embodiment, the low resolution image pattern may not be the charging time compensation pattern. When the input image data IMG having the low resolution image pattern is displayed in the second driving mode in the display panel 100 having the present exemplary pixel structure, the display defect may be generated due to the alternate connection structure of the pixel columns.

According to the present exemplary embodiment, the input image data IMG may be analyzed and the charging time of the data voltage VD may be compensated by concurrently driving the plurality of the gate lines when the image data, which may benefit from compensation of the charging time of the data voltage VD, are inputted. The charging time of the data voltage VD is compensated so that the charging rate of the data voltage VD may be enhanced. When the charging rate of the data voltage VD is enhanced, the display quality of the display panel 100 may be enhanced.

Figure 7:
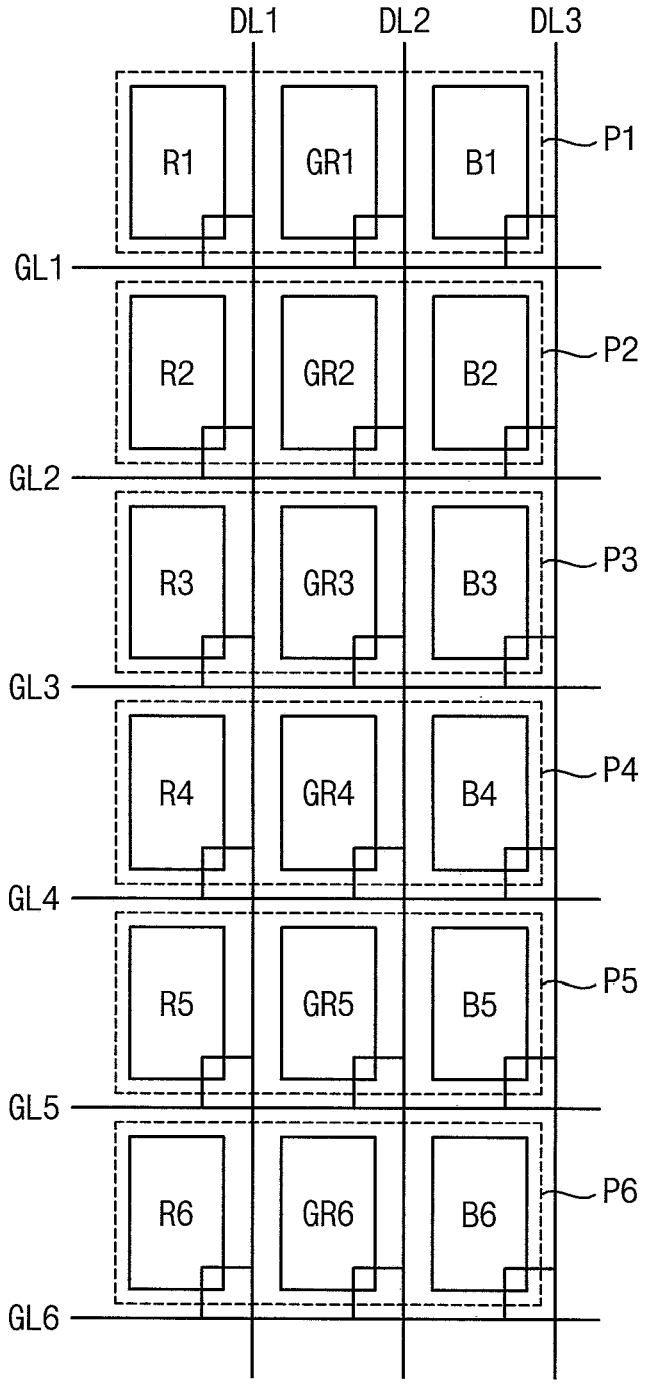
FIG. 7 is a conceptual diagram illustrating a pixel structure of a display panel according to an exemplary embodiment of the present inventive concept.
Figure 8A:
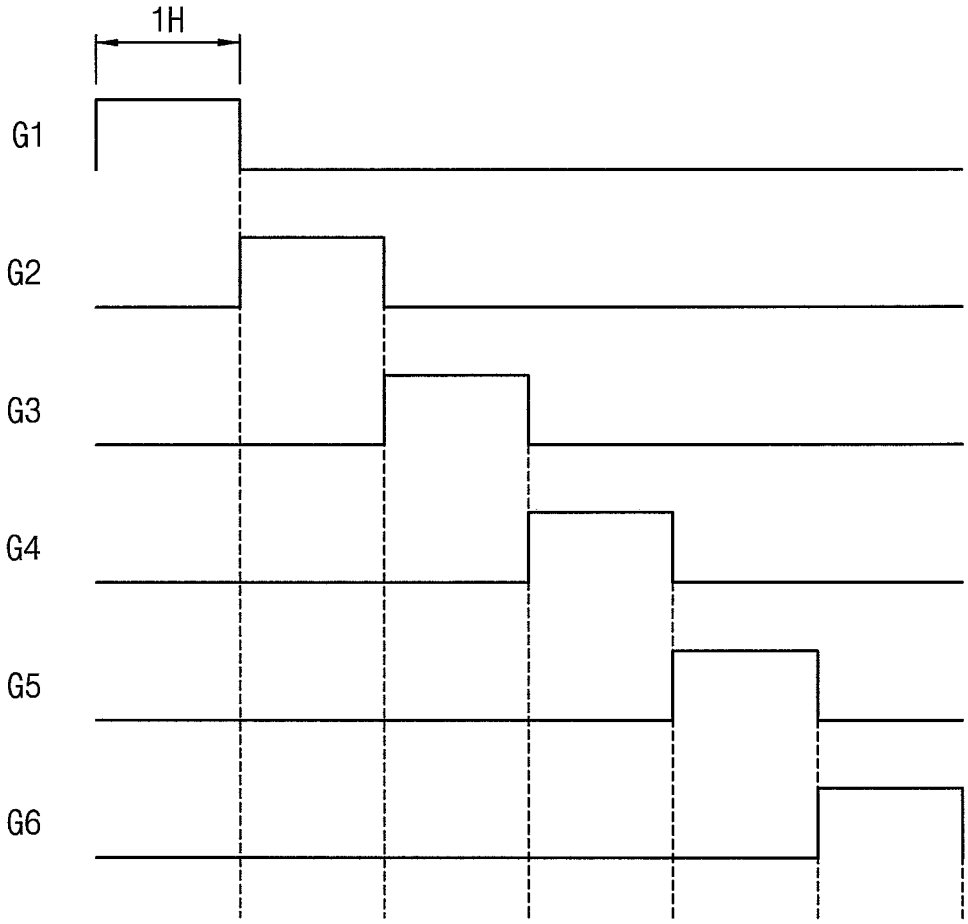
FIG. 8A is a conceptual diagram illustrating a gate signal and a data voltage applied to subpixels of FIG. 7 in a first driving mode.
Figure 8B:
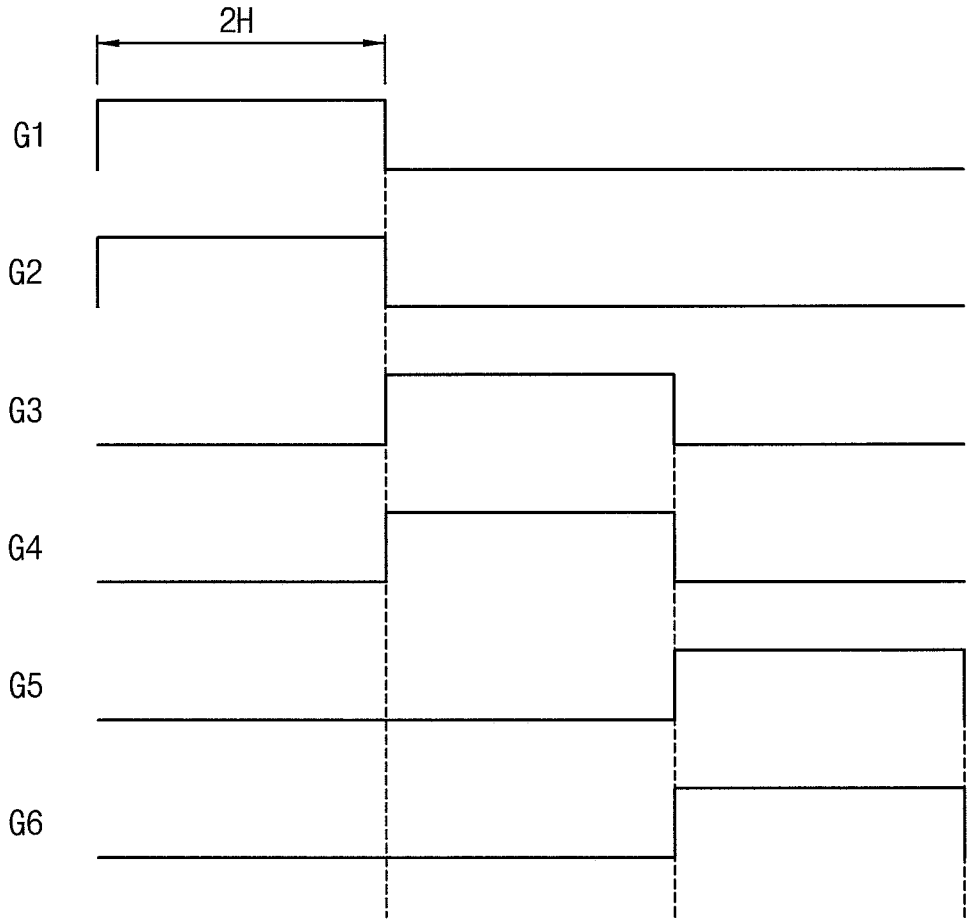
FIG. 8B is a conceptual diagram illustrating a gate signal and a data voltage applied to the subpixels of FIG. 7 in a second driving mode.

FIG. 7 is a conceptual diagram illustrating a pixel structure of a display panel according to an exemplary embodiment of the present inventive concept. FIG. 8A is a conceptual diagram illustrating a gate signal and a data voltage applied to subpixels of FIG. 7 in a first driving mode. FIG. 8B is a conceptual diagram illustrating a gate signal and a data voltage applied to the subpixels of FIG. 7 in a second driving mode.

The display apparatus and the method of driving the display panel according to the present exemplary embodiment is substantially the same as the display apparatus and the method of driving the display panel of the previous exemplary embodiment explained with reference to FIGS. 1 to 4, except for the pixel structure of the display panel and the gate signal in the second driving mode. Thus, the same reference numerals will be used to refer to the same or like parts as those described in the previous exemplary embodiment of FIGS. 1 to 4 and any repetitive explanation concerning the above elements may be omitted.

Referring to FIGS. 1, 4, 7, 8A and 8B, the display apparatus includes a display panel 100 and a display panel driver. The display panel driver includes a driving controller 200, a gate driver 300, a gamma reference voltage generator 400, and a data driver 500.

A first color subpixel, a second color subpixel and a third color subpixel are alternately disposed in a row direction D1 and subpixels having the same color are disposed in a column direction D2 in the display panel 100.

In the display panel 100, the first color subpixel R1, the second color subpixel GR1, and the third color subpixel B1 connected to a first gate line GL1 are alternately disposed in a first row; the first color subpixel R2, the second color subpixel GR2, and the third color subpixel B2 connected to a second gate line GL2 are alternately disposed in a second row; the first color subpixel R3, the second color subpixel GR3, and the third color subpixel B3 connected to a third gate line GL3 are alternately disposed in a third row; the first color subpixel R4, the second color subpixel GR4, and the third color subpixel B4 connected to a fourth gate line GL4 are alternately disposed in a fourth row; the first color subpixel R5, the second color subpixel GR5, and the third color subpixel B5 connected to a fifth gate line GL5 are alternately disposed in a fifth row and the first color subpixel R6; and the second color subpixel GR6 and the third color subpixel B6 connected to a sixth gate line GL6 are alternately disposed in a sixth row.

The first color subpixel, the second color subpixel, and the third color subpixel disposed adjacent to each other in the row direction D1 may form a pixel.

For example, red, green, and blue subpixels R1, GR1, and B1 disposed in a first row may form a first pixel P1. For example, red, green, and blue subpixels R2, GR2, and B2 disposed in a second row may form a second pixel P2. For example, red, green, and blue subpixels R3, GR3, and B3 disposed in a third row may form a third pixel P3. For example, red, green, and blue subpixels R4, GR4, and B4 disposed in a fourth row may form a fourth pixel P4. For example, red, green, and blue subpixels R5, GR5, and B5 disposed in a fifth row may form a fifth pixel P5. For example, red, green, and blue subpixels R6, GR6, and B6 disposed in a sixth row may form a sixth pixel P6.

In the present exemplary embodiment, the data line may be connected to pixels disposed in a single pixel column. For example, the first data line DL1 may be connected to the first color subpixels R1, R2, R3, R4, R5, and R6 disposed in a first pixel column. For example, the second data line DL2 may be connected to the second color subpixels GR1, GR2, GR3, GR4, GR5, and GR6 disposed in a second pixel column. For example, the third data line DL3 may be connected to the third color subpixels B1, B2, B3, B4, B5, and B6 disposed in a third pixel column.

The driving controller 200 analyzes the input image data IMG. The driving controller 200 may determine a driving mode from among one of a first driving mode and a second driving mode based on the input image data IMG. When the input image data IMG includes a charging time compensation pattern, which may benefit from a compensation of the charging time of the data voltage, the driving controller 200 may determine the driving mode as the second driving mode (e.g., a charging time compensation driving mode). When the input image data IMG does not include the charging time compensation pattern, which my benefit from the compensation of the charging time of the data voltage, the driving controller 200 may determine the driving mode as the first driving mode (e.g., a normal driving mode).

The gate driver 300 may output the gate signals having timings different from one another to the gate lines in the first driving mode.

As shown in FIG. 8A, for example, the gate driver 300 may output the gate signals having timings different from one another to the all of the gate lines of the display panel 100.

The gate driver 300 may output the gate signals having the same timing to at least two gate lines in the second driving mode.

In the present exemplary embodiment, the gate driver 300 may output the gate signals having the same timing to two adjacent gate lines connected to the same-color subpixels in the second driving mode.

As shown in FIG. 8B, in the second driving mode, a first gate signal G1 applied to the first gate line GL1 and a second gate signal G2 applied to the second gate line GL2 have active levels in a first timing, a third gate signal G3 applied to the third gate line GL3 and a fourth gate signal G4 applied to the fourth gate line GL4 have active levels in a second period different from the first timing, a fifth gate signal G5 applied to the fifth gate line GL5 and a sixth gate signal G6 applied to the sixth gate line GL6 have active levels in a third period different from the first period and the second timing.

In the present exemplary embodiment, the subpixels having the same color are disposed in the column direction so that the gate signals having the same timing may be applied to two adjacent gate lines.

In the second driving mode, two gate lines have the same timing so that a turn-on period 2 H of the gate signal when the gate signal has the active level may be twice of a turn-on period 1 H of the gate signal in the first driving mode. Thus, in the second driving mode, the charging time of the data voltage VD may be increased.

In some examples, the gate driver 300 may output the gate signals having the same timing to four adjacent gate lines connected to the same-color subpixels in the second driving mode according to the input image data IMG.

According to the present exemplary embodiment, the input image data IMG may be analyzed and the charging time of the data voltage VD may be compensated by concurrently driving the plurality of the gate lines when the image data, which may benefit from compensation of the charging time of the data voltage VD, are inputted. The charging time of the data voltage VD is compensated so that the charging rate of the data voltage VD may be enhanced. When the charging rate of the data voltage VD is enhanced, the display quality of the display panel 100 may be enhanced.

Figure 9:
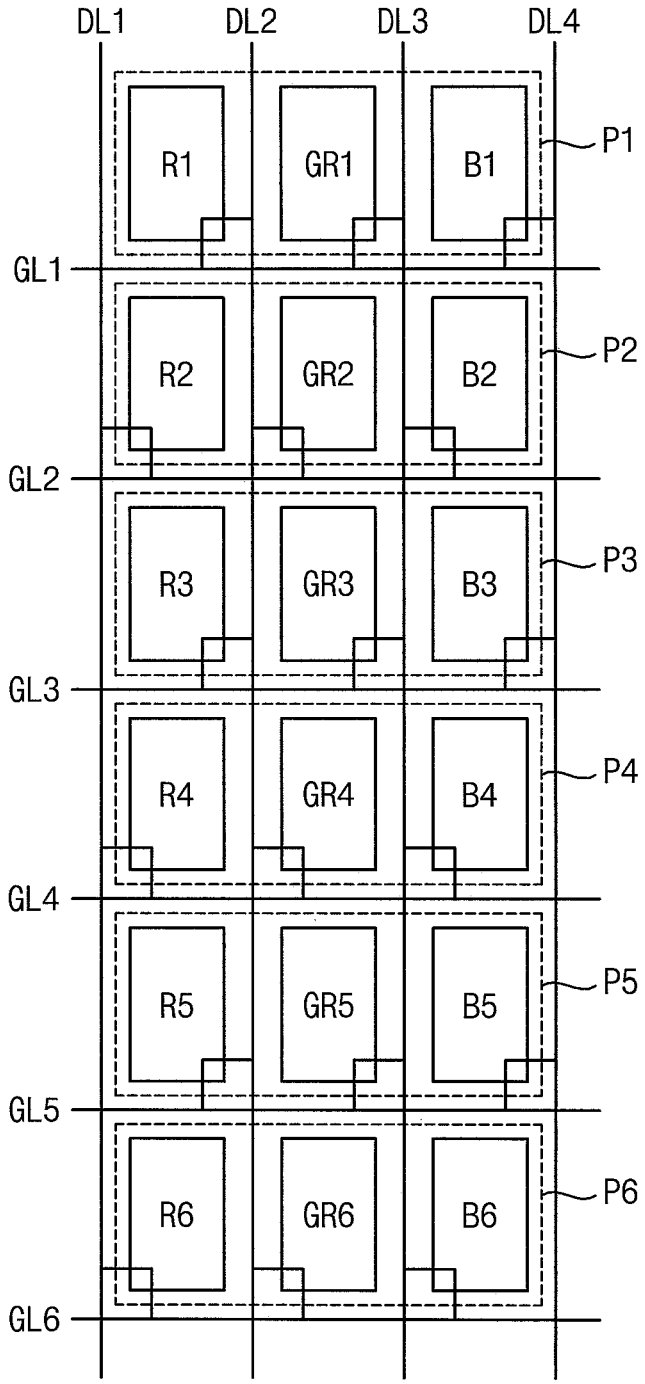
FIG. 9 is a conceptual diagram illustrating a pixel structure of a display panel according to an exemplary embodiment of the present inventive concept.

FIG. 9 is a conceptual diagram illustrating a pixel structure of a display panel according to an exemplary embodiment of the present inventive concept.

The display apparatus and the method of driving the display panel according to the present exemplary embodiment is substantially the same as the display apparatus and the method of driving the display panel of the previous exemplary embodiment explained with reference to FIGS. 7 to 8B, except for the pixel structure of the display panel. Thus, the same reference numerals will be used to refer to the same or like parts as those described in the previous exemplary embodiment of FIGS. 7 to 8B and any repetitive explanation concerning the above elements may be omitted.

Referring to FIGS. 1, 4, 8A, 8B, and 9, the display apparatus includes a display panel 100 and a display panel driver. The display panel driver includes a driving controller 200, a gate driver 300, a gamma reference voltage generator 400, and a data driver 500.

A first color subpixel, a second color subpixel and a third color subpixel are alternately disposed in a row direction D1 and subpixels having the same color are disposed in a column direction D2 in the display panel 100.

In the display panel 100, the first color subpixel R1, the second color subpixel GR1, and the third color subpixel B1 connected to a first gate line GL1 are alternately disposed in a first row; the first color subpixel R2, the second color subpixel GR2, and the third color subpixel B2 connected to a second gate line GL2 are alternately disposed in a second row; the first color subpixel R3, the second color subpixel GR3, and the third color subpixel B3 connected to a third gate line GL3 are alternately disposed in a third row; the first color subpixel R4, the second color subpixel GR4, and the third color subpixel B4 connected to a fourth gate line GL4 are alternately disposed in a fourth row; the first color subpixel R5, the second color subpixel GR5, and the third color subpixel B5 connected to a fifth gate line GL5 are alternately disposed in a fifth row and the first color subpixel R6; and the second color subpixel GR6 and the third color subpixel B6 connected to a sixth gate line GL6 are alternately disposed in a sixth row.

The first color subpixel, the second color subpixel, and the third color subpixel disposed adjacent to each other in the row direction D1 may form a pixel.

In the present exemplary embodiment, the data line may be alternately connected to pixels disposed in two adjacent pixel columns. For example, a first data line DL1 may be connected to the first color subpixels R2, R4, and R6 disposed in a first pixel column. For example, a second data line DL2 may be connected to the first color subpixels R1, R3, and R5 disposed in the first pixel column and the second color subpixels GR2, GR4, and GR6 disposed in a second pixel column. For example, a third data line DL3 may be connected to the second color subpixels GR1, GR3, and GR5 disposed in the second pixel column and the third color subpixels B2, B4, and B6 disposed in a third pixel column. For example, a fourth data line DL4 may be connected to the third color subpixels B1, B3, and B5 disposed in the third pixel column.

The driving controller 200 analyzes the input image data IMG. The driving controller 200 may determine a driving mode from among one of a first driving mode and a second driving mode based on the input image data IMG. When the input image data IMG includes a charging time compensation pattern, which may benefit from a compensation of the charging time of the data voltage, the driving controller 200 may determine the driving mode as the second driving mode (a charging time compensation driving mode). When the input image data IMG does not include the charging time compensation pattern which requires the compensation of the charging time of the data voltage, the driving controller 200 may determine the driving mode as the first driving mode (a normal driving mode).

The gate driver 300 may output the gate signals having timings different from one another to the gate lines in the first driving mode.

The gate driver 300 may output the gate signals having the same timing to at least two gate lines in the second driving mode.

In the present exemplary embodiment, the gate driver 300 may output the gate signals having the same timing to two adjacent gate lines connected to the same-color subpixels in the second driving mode.

In the present exemplary embodiment, the subpixels having the same color are disposed in the column direction so that the gate signals having the same timing may be applied to two adjacent gate lines.

In the second driving mode, two gate lines have the same timing so that a turn-on period 2 H of the gate signal when the gate signal has the active level may be twice of a turn-on period 1 H of the gate signal in the first driving mode. Thus, in the second driving mode, the charging time of the data voltage VD may be increased.

According to the present exemplary embodiment, the input image data IMG may be analyzed and the charging time of the data voltage VD may be compensated by concurrently driving the plurality of the gate lines when the image data, which may benefit from compensation of the charging time of the data voltage VD, are inputted. The charging time of the data voltage VD is compensated so that the charging rate of the data voltage VD may be enhanced. When the charging rate of the data voltage VD is enhanced, the display quality of the display panel 100 may be enhanced.

Figure 10:
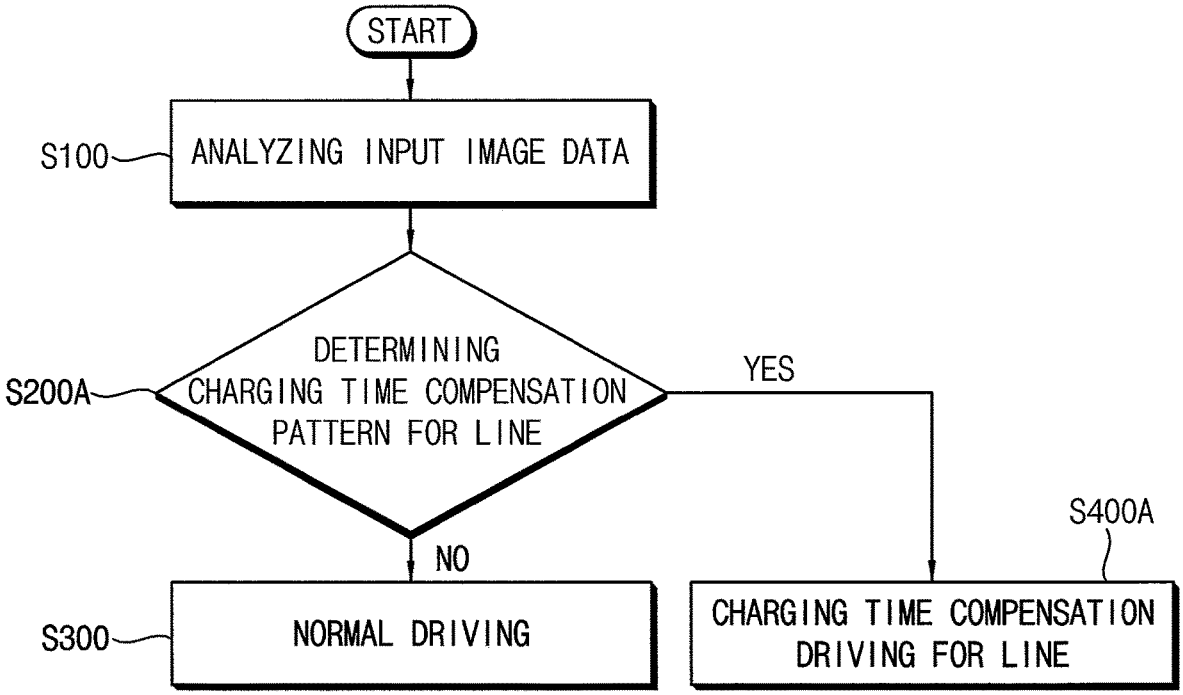
FIG. 10 is a flow diagram illustrating a method of driving a display panel according to an exemplary embodiment of the present inventive concept.
Figure 11:
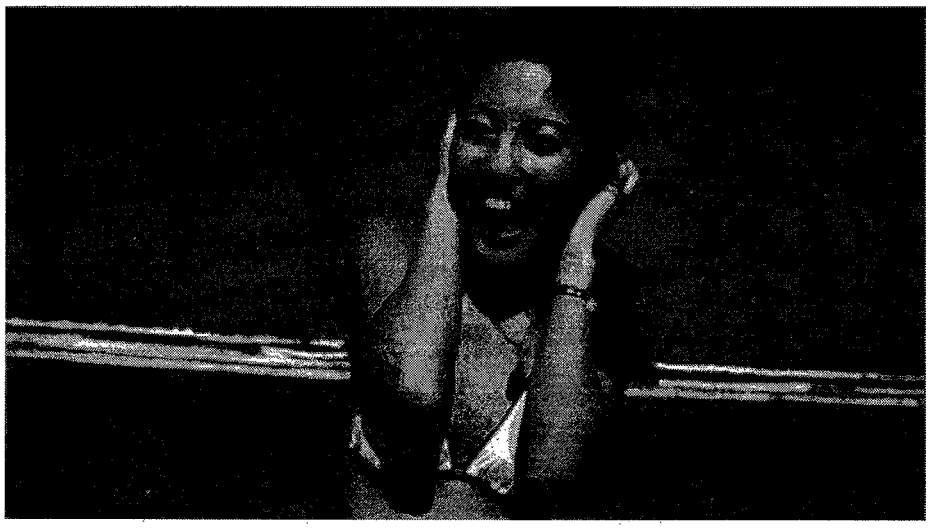
FIG. 11 is a conceptual diagram illustrating first input image data inputted to the display panel of FIG. 10.
Figure 12:
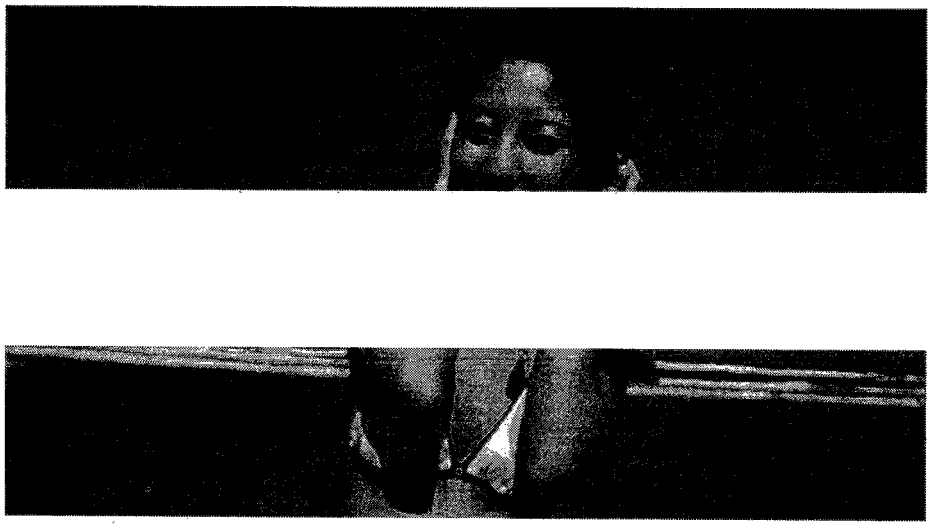
FIG. 12 is a conceptual diagram illustrating second input image data inputted to the display panel of FIG. 10.
Figure 13A:
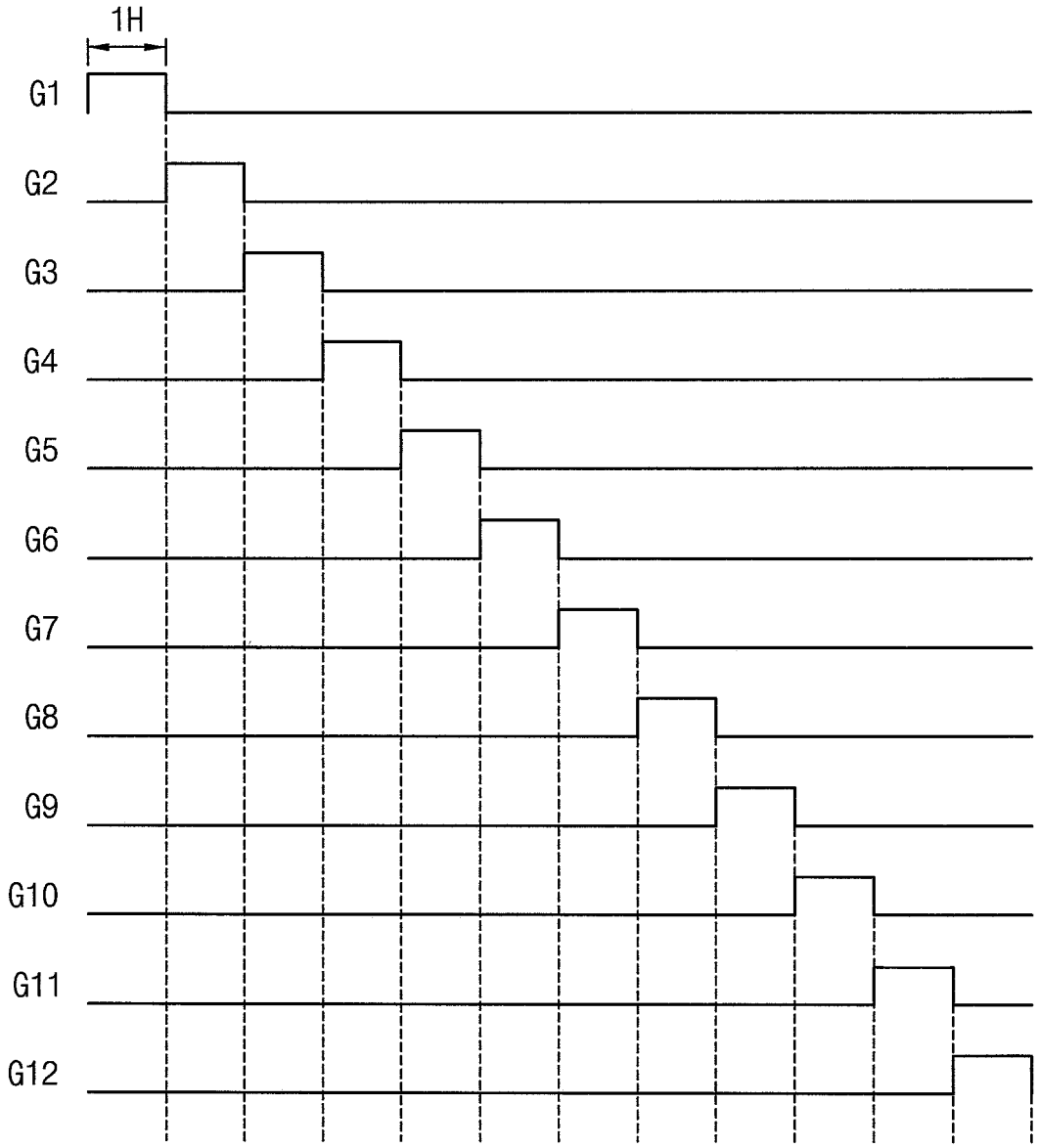
FIG. 13A is a conceptual diagram illustrating a gate signal applied to subpixels of the display panel of FIG. 10 in a first driving mode.
Figure 13B:
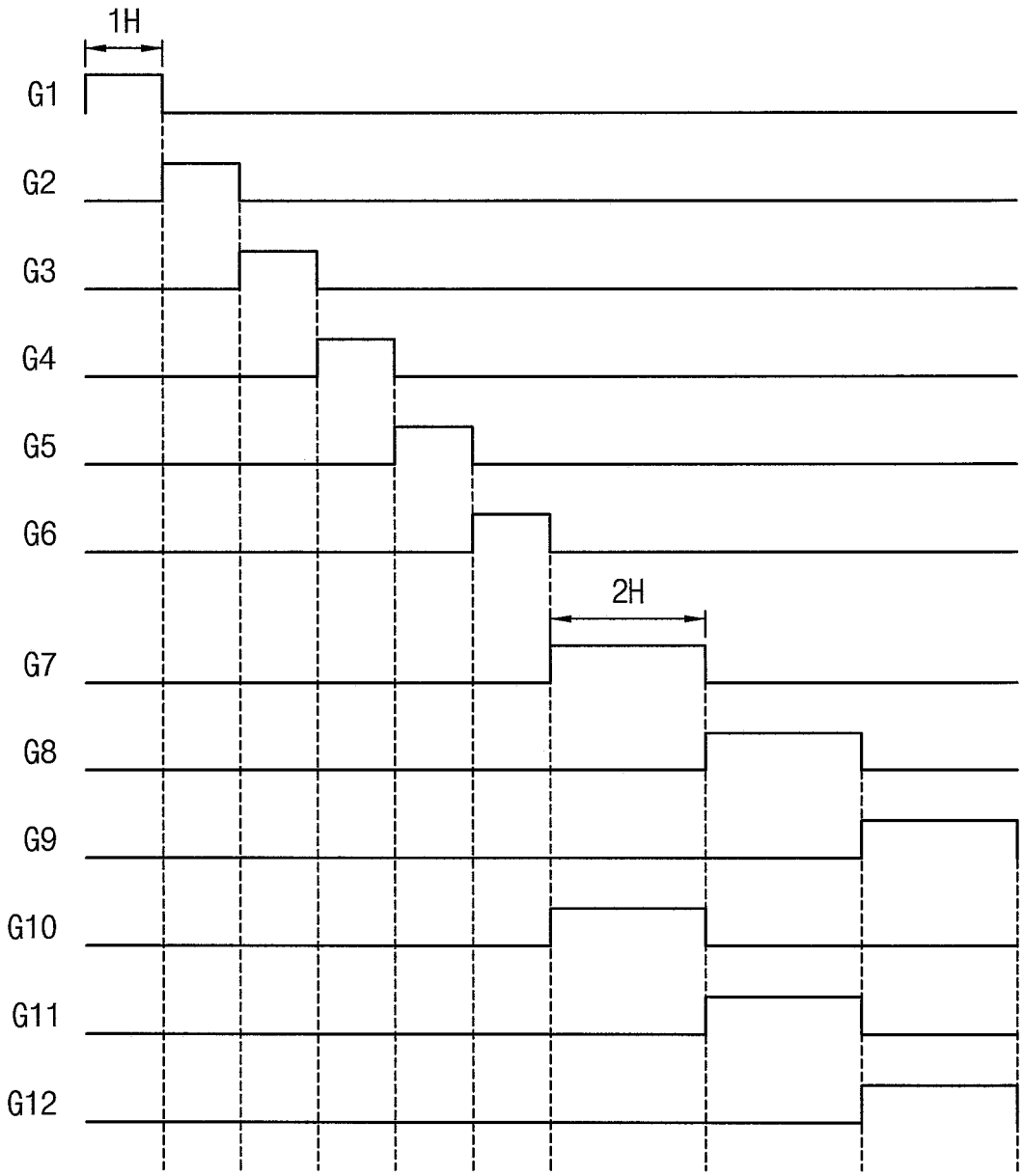
FIG. 13B is a conceptual diagram illustrating a gate signal applied to subpixels of the display panel of FIG. 10 in a second driving mode.

FIG. 10 is a flow diagram illustrating a method of driving a display panel according to an exemplary embodiment of the present inventive concept. FIG. 11 is a conceptual diagram illustrating first input image data inputted to the display panel of FIG. 10. FIG. 12 is a conceptual diagram illustrating second input image data inputted to the display panel of FIG. 10. FIG. 13A is a conceptual diagram illustrating a gate signal applied to subpixels of the display panel of FIG. 10 in a first driving mode. FIG. 13B is a conceptual diagram illustrating a gate signal applied to subpixels of the display panel of FIG. 10 in a second driving mode.

The display apparatus and the method of driving the display panel according to the present exemplary embodiment is substantially the same as the display apparatus and the method of driving the display panel of the previous exemplary embodiment explained with reference to FIGS. 1 to 4, except that the driving controller determines the charging time compensation pattern line by line. Thus, the same reference numerals will be used to refer to the same or like parts as those described in the previous exemplary embodiment of FIGS. 1 to 4 and any repetitive explanation concerning the above elements may be omitted.

Referring to FIGS. 1, 2, and 10-13B, the display apparatus includes a display panel 100 and a display panel driver. The display panel driver includes a driving controller 200, a gate driver 300, a gamma reference voltage generator 400, and a data driver 500.

In the present exemplary embodiment, the display panel 100 may have the pixel structure of FIG. 2 for convenience of explanation.

The driving controller 200 analyzes the input image data IMG (S100). The driving controller 200 may determine a driving mode from among one of a first driving mode and a second driving mode based on the input image data IMG (S200A). When the input image data IMG includes a charging time compensation pattern, which may benefit from a compensation of the charging time of the data voltage, the driving controller 200 may determine the driving mode as the second driving mode (e.g., a charging time compensation driving mode). When the input image data IMG does not include the charging time compensation pattern which requires the compensation of the charging time of the data voltage, the driving controller 200 may determine the driving mode as the first driving mode (e.g., a normal driving mode).

In the present exemplary embodiment, the driving controller 200 may generate the input image data IMG line by line and may determine the driving mode from among one of the first driving mode and the second driving mode for each line.

Accordingly, a first portion of the frame image may be displayed on the display panel 100 in the first driving mode and a second portion of the frame image may be displayed on the display panel 100 in the second driving mode.

The frame image of FIG. 11 does not include the charging time compensation pattern so that the frame image of FIG. 11 may be displayed in the normal driving mode (S300).

The gate driver 300 may output the gate signals having timings different from one another to the gate lines in the first driving mode (S300).

As shown in FIG. 13A, for example, the gate driver 300 may output the gate signals having timings different from one another to the all of the gate lines of the display panel 100.

The gate driver 300 may output the gate signals having the same timing to at least two gate lines in the second driving mode (S400A).

An upper portion and a lower portion of the frame image of FIG. 12 does not include the charging time compensation pattern but a central portion of the frame image of FIG. 12 includes the charging time compensation pattern which is a white pattern.

Thus, the upper portion and the lower portion of the frame image of FIG. 12 may be displayed in the first driving mode but the central portion of the frame image of FIG. 12 may be displayed in the second driving mode.

In FIG. 13B, first to sixth gate signals G1 to G6 applied to first to sixth gate lines may be driven in the first driving mode and seventh to twelfth gate signals G7 to G12 applied to seventh to twelfth gate lines may be driven in the second driving mode.

As shown in FIG. 13B, in the second driving mode, the seventh gate signal G7 applied to the seventh gate line and the tenth gate signal G10 applied to the tenth gate line have active levels in a first timing, the eighth gate signal G8 applied to the eighth gate line and the eleventh gate signal G11 applied to the eleventh gate line have active levels in a second period different from the first timing, the ninth gate signal G9 applied to the ninth gate line and the twelfth gate signal G12 applied to the twelfth gate line have active levels in a third period different from the first period and the second timing.

In the present exemplary embodiment, the driving controller 200 analyzes the input image data IMG line by line and determines the driving mode from among one of the first driving mode and the second driving mode based on the input image data IMG for each line so that the charging rate of the data voltage VD may be efficiently compensated.

According to the present exemplary embodiment, the input image data IMG may be analyzed and the charging time of the data voltage VD may be compensated by concurrently driving the plurality of the gate lines when the image data, which may benefit from compensation of the charging time of the data voltage VD, are inputted. The charging time of the data voltage VD is compensated so that the charging rate of the data voltage VD may be enhanced. When the charging rate of the data voltage VD is enhanced, the display quality of the display panel 100 may be enhanced.

According to the exemplary embodiments of the display apparatus and the method of driving the display panel, the charging time of the data voltage is compensated so that the display quality of the display panel may be enhanced.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "lower", "upper", and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display apparatus and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display apparatus may be formed on one integrated circuit (IC) chip or on separate IC chips. Further, the various components of the display apparatus may be implemented on a flexible printed circuit film, a tape carrier package (TCP), a printed circuit board (PCB), or formed on a same substrate. Further, the various components of the display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined by the claims, and equivalents thereof. In the claims, means-plus-function clauses are intended to cover the structures described herein as performing the recited function and also equivalent structures.

What is claimed is:

1. A display apparatus comprising:

a display panel comprising a plurality of gate lines, a plurality of data lines, and a plurality of subpixels, the subpixels being connected to the gate lines and the data lines;

a driving controller configured to analyze input image data and to determine a driving mode from among one of a first driving mode and a second driving mode;

a gate driver configured to output gate signals having timings different from one another to the gate lines in the first driving mode and to output gate signals having the same timing to at least two gate lines in the second driving mode; and a data driver configured to output data voltages to the data lines, wherein the driving controller is configured to determine the driving mode as the second driving mode when the input image data comprises a single color pattern or when adjacent same-color subpixels in two by two matrix have the same grayscale level in the input image data.

2. The display apparatus of claim 1, wherein subpixels having the same color are arranged in a row direction in the display panel, and wherein a subpixel having a first color, a subpixel having a second color and a subpixel having a third color are alternately arranged in a column direction in the display panel.

3. The display apparatus of claim 2, wherein subpixels having the first color and connected to a first gate line are arranged in a first row, subpixels having the second color and connected to a second gate line are arranged in a second row, subpixels having the third color and connected to a third gate line are arranged in a third row, subpixels having the first color and connected to a fourth gate line are arranged in a fourth row, subpixels having the second color and connected to a fifth gate line are arranged in a fifth row, and subpixels having the third color and connected to a sixth gate line are arranged in a sixth row in the display panel, and wherein, in the second driving mode, a first gate signal applied to the first gate line and a fourth gate signal applied to the fourth gate line have active levels in a first period, a second gate signal applied to the second gate line and a fifth gate signal applied to the fifth gate line have active levels in a second period different from the first period, a third gate signal applied to the third gate line and a sixth gate signal applied to the sixth gate line have active levels in a third period different from the first period and the second period.

4. The display apparatus of claim 2, wherein subpixels having the first color and connected to a first gate line are arranged in a first row, subpixels having the second color and connected to a second gate line are arranged in a second row, subpixels having the third color and connected to a third gate line are arranged in a third row, subpixels having the first color and connected to a fourth gate line are arranged in a fourth row, subpixels having the second color and connected to a fifth gate line are arranged in a fifth row, subpixels having the third color and connected to a sixth gate line are arranged in a sixth row, subpixels having the first color and connected to a seventh gate line are arranged in a seventh row, subpixels having the second color and connected to an eighth gate line are arranged in an eighth row, subpixels having the third color and connected to a ninth gate line are arranged in a ninth row, subpixels having the first color and connected to a tenth gate line are arranged in a tenth row, subpixels having the second color and connected to an eleventh gate line are arranged in an eleventh row, and subpixels having the third color and connected to a twelfth gate line are arranged in a twelfth row in the display panel, and wherein, in the second driving mode, a first gate signal applied to the first gate line, a fourth gate signal applied to the fourth gate line, a seventh gate signal applied to the seventh gate line, and a tenth gate signal applied to the tenth gate line have active levels in a first period, wherein a second gate signal applied to the second gate line, a fifth gate signal applied to the fifth gate line, an eighth gate signal applied to the eighth gate line, and an eleventh gate signal applied to the eleventh gate line have active levels in a second period different from the first period, and wherein a third gate signal applied to the third gate line, a sixth gate signal applied to the sixth gate line, a ninth gate signal applied to the ninth gate line, and a twelfth gate signal applied to the twelfth gate line have active levels in a third period different from the first period and the second period.

5. The display apparatus of claim 2, wherein the data lines are connected to the subpixels having the first color, the subpixels having the second color, and the subpixels having the third color arranged in a single pixel column.

6. The display apparatus of claim 2, wherein the data lines are alternately connected to the subpixels having the first color, the subpixels having the second color, and the subpixels having the third color arranged in two adjacent pixel columns.

7. The display apparatus of claim 6, wherein the driving controller is configured to determine the driving mode as the second driving mode when the input image data comprises a single color pattern.

8. The display apparatus of claim 1, wherein a subpixel having a first color, a subpixel having a second color and a subpixel having a third color are alternately arranged in a row direction in the display panel, and wherein subpixels having the same color are arranged in a column direction in the display panel.

9. The display apparatus of claim 8, wherein, in the second driving mode, a first gate signal applied to a first gate line and a second gate signal applied to a second gate line have active levels in a first period, a third gate signal applied to a third gate line and a fourth gate signal applied to a fourth gate line have active levels in a second period different from the first period, and a fifth gate signal applied to a fifth gate line and a sixth gate signal applied to a sixth gate line have active levels in a third period different from the first period and the second period.

10. The display apparatus of claim 8, wherein, in the second driving mode, first to fourth gate signals respectively applied to a first to fourth gate lines have active levels in a first period, fifth to eighth gate signals respectively applied to fifth to eighth gate lines have active levels in a second period different from the first period, and ninth to twelfth gate signals respectively applied to ninth to twelfth gate lines have active levels in a third period different from the first period and the second period.

11. The display apparatus of claim 1, wherein the driving controller is configured to analyze the input image data frame by frame and to determine the driving mode from among one of the first driving mode and the second driving mode for a frame.

12. The display apparatus of claim 1, wherein the driving controller is configured to analyze the input image data line by line and to determine the driving mode from among one of the first driving mode and the second driving mode for a line, and wherein a first portion of a frame image is displayed on the display panel in the first driving mode and a second portion of the frame image is displayed on the display panel in the second driving mode.

13. A method of driving a display panel, the method comprising:

analyzing input image data;

determining a driving mode from among one of a first driving mode and a second driving mode based on the input image data;

outputting gate signals having timings different from one another to gate lines of the display panel in the first driving mode and outputting gate signals having the same timing to at least two gate lines in the second driving mode; and outputting data voltages to data lines of the display panel, wherein the driving mode is determined as the second driving mode when the input image data comprises a single color pattern or when adjacent same-color sub-pixels in two by two matrix have the same grayscale level in the input image data.

14. The method of claim 13, wherein the input image data are analyzed frame by frame and the driving mode is determined from among one of the first driving mode and the second driving mode for a frame.

15. The method of claim 13, wherein the input image data are analyzed line by line and the driving mode is determined from among one of the first driving mode and the second driving mode for a line, and wherein a first portion of a frame image is displayed on the display panel in the first driving mode and a second portion of the frame image is displayed on the display panel in the second driving mode.

* * * * *